US006547056B2

(12) United States Patent
Tomioka

(10) Patent No.: US 6,547,056 B2
(45) Date of Patent: Apr. 15, 2003

(54) COIN COUNTING DEVICE

(75) Inventor: Akira Tomioka, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 119 days.

(21) Appl. No.: 09/749,718

(22) Filed: Dec. 28, 2000

(65) Prior Publication Data

US 2001/0011006 A1 Aug. 2, 2001

(30) Foreign Application Priority Data

Jan. 27, 2000 (JP) ..... 2000-19297

(51) Int. Cl.[7] ..... G07F 5/02
(52) U.S. Cl. ..... 194/232; 194/247; 194/238
(58) Field of Search ..... 194/232, 229, 194/237, 238, 247, 290, 291, 344

(56) References Cited

U.S. PATENT DOCUMENTS

| | | | | | |
|---|---|---|---|---|---|
| 3,229,797 | A | * | 1/1966 | Stackhouse | 194/232 |
| 3,265,177 | A | * | 8/1966 | Knickerbocker | 194/247 |
| 3,430,747 | A | * | 3/1969 | Hall | 194/291 |
| 3,951,246 | A | | 4/1976 | Hall | 194/9 R |
| 4,499,983 | A | * | 2/1985 | Gitlin et al. | 194/229 |
| 6,062,370 | A | * | 5/2000 | Nikolayev et al. | 194/219 |

FOREIGN PATENT DOCUMENTS

| | | | | |
|---|---|---|---|---|
| DE | 3724683 A | * | 2/1988 | G07F/5/02 |
| EP | 0 261 838 | | 3/1988 | G07D/1/00 |
| GB | 333747 | | 8/1930 | |
| GB | 1322327 | | 7/1973 | G07F/5/04 |
| GB | 2195804 A | * | 4/1988 | G07F/17/12 |
| JP | 10334304 | | 12/1998 | G07D/9/00 |

* cited by examiner

*Primary Examiner*—Donald P. Walsh
*Assistant Examiner*—Mark Beauchaine
(74) *Attorney, Agent, or Firm*—Staas & Halsey LLP

(57) ABSTRACT

A coin counting device which comprises: a coin temporary reserve member (3) for temporarily reserving coins therein in a standing condition, the coin temporary reserve member (3) being able to move reciprocally and laterally between a temporary reserve position and a transfer position; and an engaging member (32) which inhibits the coin temporary reserve member (3) to move from the temporary reserve position to the transfer position when the number of coins reserved in the temporary reserve member is smaller than a predetermined number, and which permits the temporary reserve member to move from the temporary reserve position to the transfer position when the number of coins reserved therein is equal to the predetermined number.

9 Claims, 5 Drawing Sheets

COIN COUNTING DEVICE

BACKGROUND OF THE INVENTION

1. Field of the Invention

The present invention relates to a coin counting device which is used in, for example, an automatic vending machine for selling toys contained capsules.

It is noted that the term "coin" throughout the specification should be considered in a wide concept which should not exclude those other than the so-called coins or hard money, including game coins or the like.

2. Description of Earlier Development

Hereinafter, there has been well-known, as one used in a manually operated automatic vending machine, an apparatus for determining whether coins are false or not and for counting a number of coins, as disclosed in Japanese Laid-Open Utility Model Application No. Jitsukai-hei 2-133774. Such an apparatus has a structure for excluding false coins, which automatically discharges a false coin or which can prevent a knob for extracting a toy or the like from being rotated in the case of using a false coin. Further, the apparatus determines whether a predetermined number of coins are slotted into or not.

In the above-described conventional apparatus, the determination whether a coin is false or not is carried out in view a diameter or a weight of the coin, but this determination is difficult in such a case that a relatively elaborated coin is used. Thus, an exquisite coin sorting device has been conventionally envisaged as disclosed in Japanese Laid-Open Patent Application No. Tokukai-sho 52-46000. However, this coin sorting device does not have a function of counting coins, and should this coin sorting device be combined with the coin counting device disclosed in the Japanese Laid-Open Utility Model Application No. Jitsukai-hei 2-1333774, a large space for installation would be required.

SUMMARY OF THE INVENTION

The present invention has been made for solving such problems.

An object of the present invention is to provide a coin counting device which has a simple structure and which requires a small space for installation.

Another object of the present invention is to provide a coin counting device which is effective even in combination with a coin sorting device for determining whether a coin is false for not.

That is, in accordance with an aspect of the invention, the coin counting device comprises:

a coin temporary reserve member for temporarily reserving coins therein in a standing condition, the coin temporary reserve member being able to move reciprocally and laterally between a temporary reserve position and a transfer position; and an engaging member which inhibits the coin temporary reserve member to move from the temporary reserve position to the transfer position when the number of coins reserved in the temporary reserve member is smaller than a predetermined number, and which permits the temporary reserve member to move from the temporary reserve position to the transfer position when the number of coins reserved therein is equal to the predetermined number.

In accordance with another aspect of the invention, the coin counting device comprises:

a coin temporary reserve member for temporarily reserving coins therein in a standing condition, the coin temporary reserve member being able to move reciprocally and laterally between a temporary reserve position at which a coin can be put into the temporary reserve portion and a transfer position at which no coin can be put therein; and an engaging member which inhibits the coin temporary reserve member to move from the temporary reserve position to the transfer position when the number of coins reserved in the temporary reserve member is smaller than a predetermined number, and which permits the temporary reserve member to move from the temporary reserve position to the transfer position when the number of coins reserved therein is equal to the predetermined number.

Preferably, the coin counting device further comprises: a base plate on which the coin temporary reserve member is provided; a stopper member provided on the base plate, for supporting a coin in the coin temporary reserve member from a lower side to prevent the coin from dropping out of the coin temporary reserve member while the coin temporary reserve member is at the temporary reserve position, and for releasing a support for the coin to permit the coin to drop out of the coin temporary reserve member while the coin temporary reserve member is at the transfer position; and the engaging member provided on the base plate, which presses a surface of the coin in the coin temporary reserve member by a predetermined urging force, while the coin temporary reserve member to move from the temporary reserve position to the transfer position.

The temporary reserving member may comprise a scraper for removing the surplus coins from the temporary reserve member when the temporary reserve member is moved from the temporary reserve position to the transfer position.

The coin counting device may further comprises a coin number adjusting mechanism for increasing or decreasing the predetermined number of coins to be temporarily reserved.

This coin counting device can be used in combination with a coin sorting device for determining whether a coin is false or not. As this coin sorting device, a coin sorting device which is disclosed, for example, in the Japan ese Laid-Open Utility Model Application No. Tokukai-sho 52-46000, Japanese Laid-Open Patent Application No. Tokukai-sho 52-57894 or the like is preferably used. Thus, in combination of this coin sorting device, the apparatus can be simply incorporated in an automatic vending machine or the like in which the determination whether a coin is false or not is indispensable. In this arrangement, if a manipulating knob for discharging a commodity or the like is coupled to the temporary reserve member, it is possible to prevent the manipulating knob from being manipulated, until a predetermined number of coins have been cast into. In this case, it is natural that no false coin is reserved in the temporary reserve member since a false coin can be determined by the coin sorting device even though the false coin is cast into.

It is noted that the coin counting device is provided therein with a scarper, and is adapted to carry surplus coins on a predetermined number of coins which have been temporarily reserved, and in this condition, when the temporary reserve member is moved toward the transfer position, the surplus coins can be prevented from being moved and can be removed from the temporary reserve member.

Further, there may be provided a coin number adjusting mechanism for adjusting the predetermined number of reserved coins.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein;

FIG. 5 is a vertical sectional view illustrating an arrangement of an adjusting mechanism for adjusting the number of coins to be slotted in.

PREFERRED EMBODIMENT OF THE INVENTION

Figure 1:
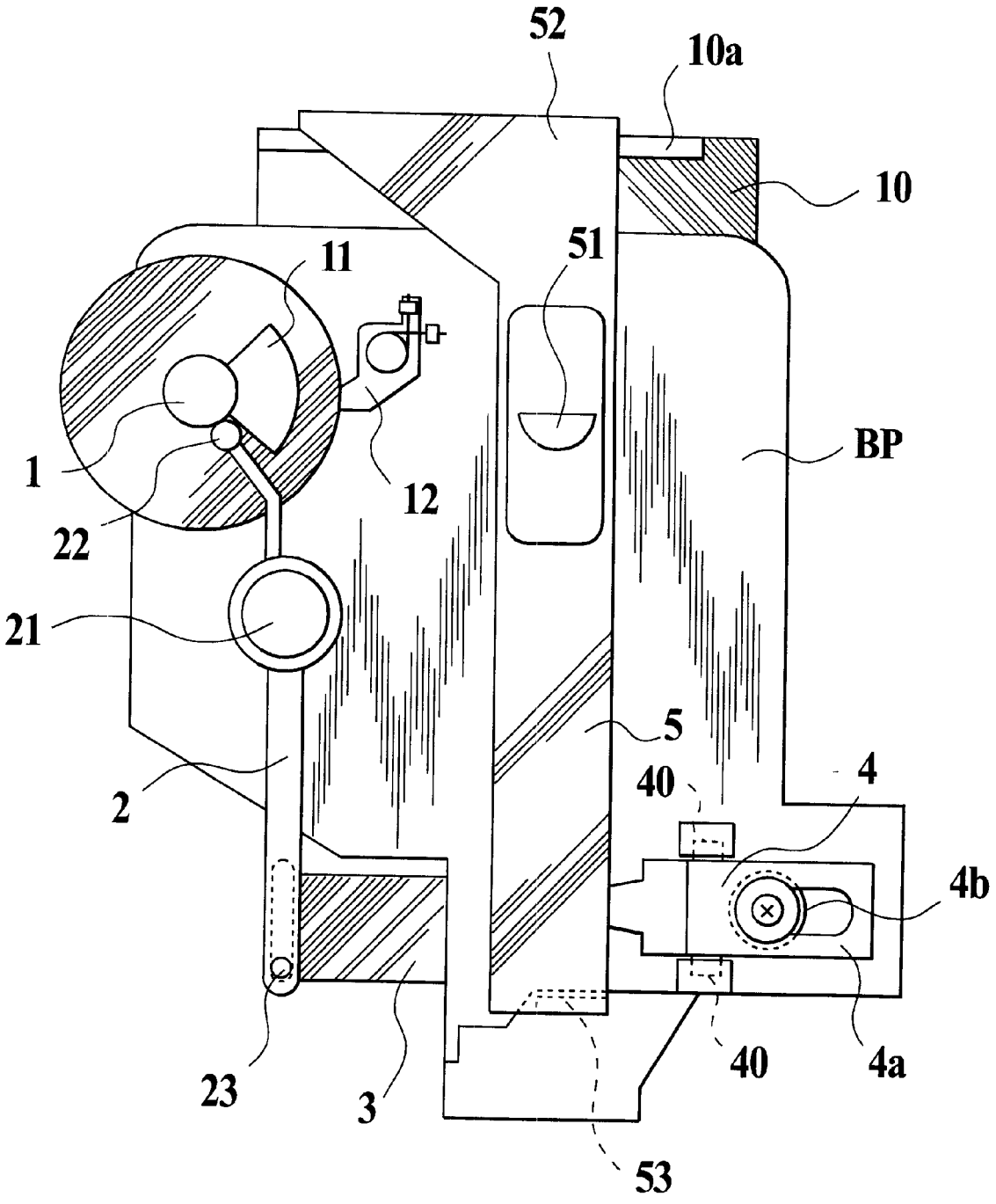
FIG. 1 is a front view illustrating an embodiment of the coin counting device according to the present invention.

FIG. 1 shows an embodiment of the coin counting device according to the present invention.

The coin counting device is provided with a coin temporary reserve member 3 for temporarily reserving coins therein in a standing condition, the coin temporary reserve member 3 being able to move reciprocally and laterally between a temporary reserve position at which a coin can be put into the temporary reserve portion 6 and a transfer position at which no coin can be put thereinto; and an engaging member 32 which inhibits the coin temporary reserve member to move from the temporary reserve position to the transfer position when the number of coins reserved in the temporary reserve member is smaller than a predetermined number, and which permits the temporary reserve member to move from the temporary reserve position to the transfer position when the number of coins reserved therein is equal to the predetermined number.

In FIG. 1, there is shown a rotary shaft 1 on which a manipulating knob is attached, and which is rotatably fitted to a stationary base plate BP. Further, the rotary shaft 1 is integrally incorporated thereto with a cam 11 with a sector form. In the vicinity of the rotary shaft 1, a ratchet pawl 12 is attached, and is adapted to engage with a ratchet (which is not shown) which is integrally incorporated with the rotary shaft 1 so that the rotary shaft 1 can be prevented from being rotated in a counterclockwise direction in the figure. Further, there is shown a coupling lever 2 which is attached to the stationary base plate BP so as to be swingable around a shaft 21 to swing, which is provided on the stationary base plate BP. The cam 11 abuts against the upper end portion 22 of the coupling lever 2. Further, when the rotary shaft 1 is rotated in the clockwise direction in the figure, the upper end portion 22 is pressed leftward by the cam 11. Accordingly, the coupling lever 2 is rotated in the counterclockwise direction to move a coupling pin 23 formed at the lower end of the coupling lever 2 rightward. This coupling pin 23 is engaged with a stocker 3 which is a temporary reserve member. Since the stocker 3 is held on the stationary base plate BP so as to be reciprocally movable left and right, when the coupling pin 23 is moved in the right direction, the stocker 3 is thereby moved in the right direction in the figure. Incidentally, if a predetermined number of coins are not yet contained in the stocker 3, the stocker 3 is inhibited from being moved in the right direction, under the action of an engaging piece 4. Then, the cam 11 is limited by the upper end portion 22, and accordingly, it cannot be rotated in the clockwise direction around the rotary shaft 1. It is noted that the engaging piece 4 is attached to the stationary base plate BP by means of a support shaft 40 which projects vertically, to be swingable around the support shaft 40. Further, a coil spring **4*b* is arranged between and compressed by a tail portion 4*a* of the engaging piece 4 and the stationary base plate BP. Further, there is a coin sorting device 10 which is attached to the stationary base plate BP, as shown in FIG. 1. The coin sorting device 10 is provided with a release lever 10*a* (refer to FIGS. 1 and 2) and is urged upward by a spring (which is not shown). A stopper member 5 is provided on the stationary base plate BP so as to be movable vertically. On a side surface of the stopper member 5, a protrusion 51 is integrally formed. When the protrusion 51 is nipped and moved downward, the upper end 52 of the stopper member 5 presses the release lever 10*a* down, against the force of the spring. Accordingly, a coin which: is caught in the coin sorting device 10 or a false coin can be forcibly discharged. The stopper member 5 is provided at its lower end with a stopper portion 53 for supporting a regular coin which has been paid out from the coin supporting device 10 to the stocker 3. Thereby, it is possible to prevent the coin from dropping out of the stocker 3**.

Figure 2:
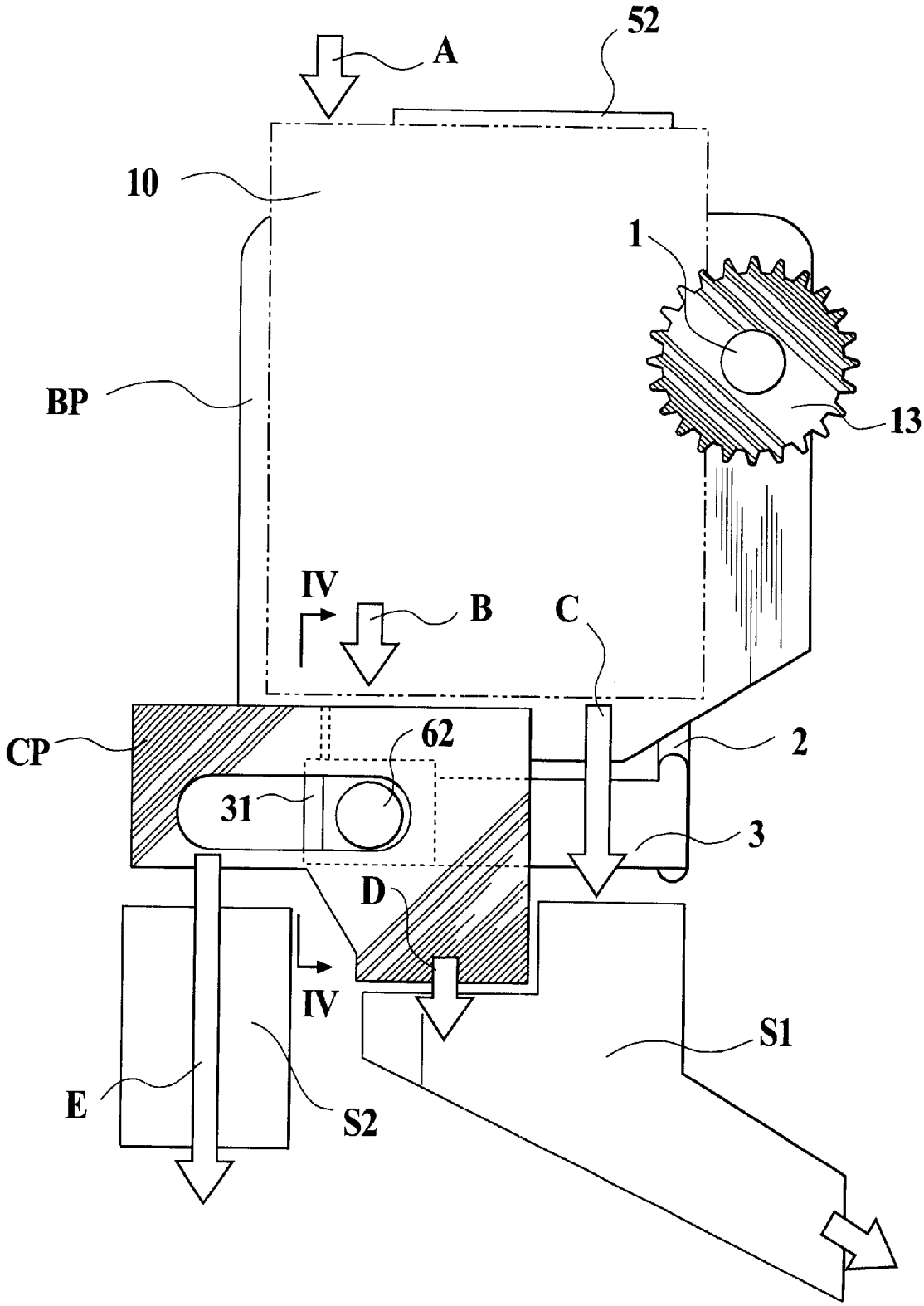
FIG. 2 is a rear view illustrating the coin counting device shown in FIG. 1.

When a coin or coins are inserted into the coin sorting device 10 along the arrow A, as shown in FIG. 2, the coins are sorted in the coin sorting device 10, and then, only desired regular coins are paid out along the arrow B, and the other coins or false coins are paid out along the arrow C. The surplus coin is finally discharged along the arrow D even when the one was paid out along the arrow B, and is transferred to the outside through a shooter S1, like the case of the coins which have been paid out along the arrow C. The stocker 3 can be moved from the temporary reserve position shown in FIG. 2 and at which the regular coin from the coin sorting device 10 is put into the temporary reserve portion 6 and reserved, to the transfer position which is one apart from the temporary reserve position leftward. When the stocker 3 has been moved to the transfer position, the coins are not yet supported by the above-mentioned stopper portion 53, and accordingly, the temporary reserved coins are transferred into a reserving container (which is not shown) through a shooter S2 along the arrow E. It is noted that the reference numeral 13 denotes a gear which is adapted to operate a discharge mechanism (which is not shown) for discharging capsules in association with the rotation of the rotary shaft 1.

Figure 3:
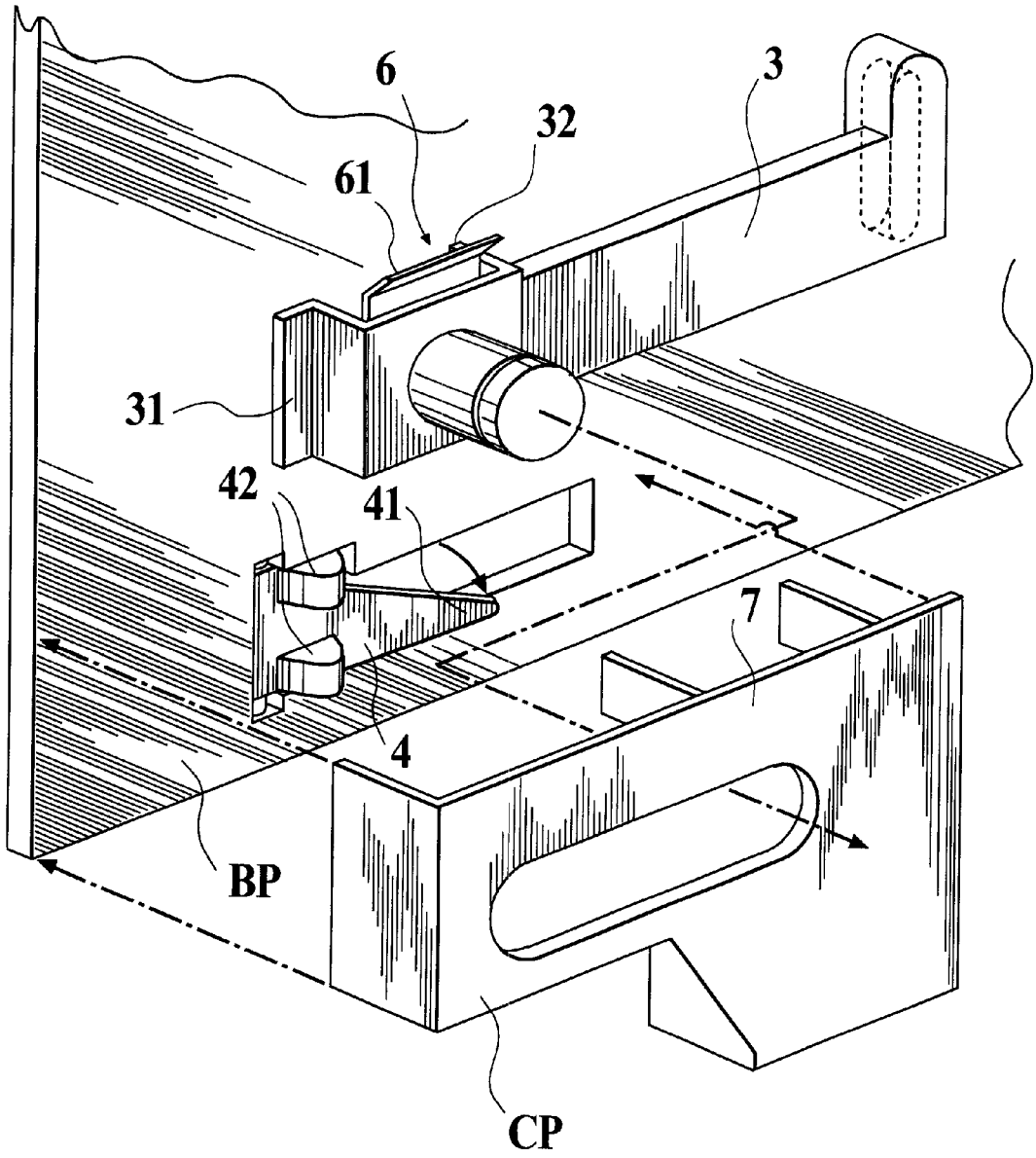
FIG. 3 is an exploded perspective view illustrating a stocker in an attached condition.

The stocker 3 is held by sandwiching between the stationary base plate BP and a cover plate CP attached to the stationary base plate BP, so that the stocker 3 can move left and right, as shown in FIG. 3. The stocker 3 is provided with a U-like temporary reserve portion 6 which is formed integrally at its left end side. At the left end of the temporary reserve portion 6, a retaining portion 31 is formed. The retaining portion 31 presses cam portions 42 of the engaging piece 4 so as to prevent the top end 41 of the engaging piece 4 from being projected forward from the surface of the stationary base plate B when the stocker 3 is located at the temporary reserve position. When the leftward movement of the stocker 3 toward the transfer position is initiated, the retaining portion 31 is separated from the cam portion 42, and accordingly, the top end 41 enters the temporary reserve portion 6. When a predetermined number of coins are not yet reserved in the temporary reserve portion 6, the top end 41 enters into the temporary reserve portion 6 to a large extent under the urging force of the coil spring 4*b*, and the top end 41 is then engaged with an engaging portion 32 which forms the left side wall surface of the temporary reserve portion 6. Thus, the stocker 3 is inhibited from being further moved toward the transfer position.

Figure 4:
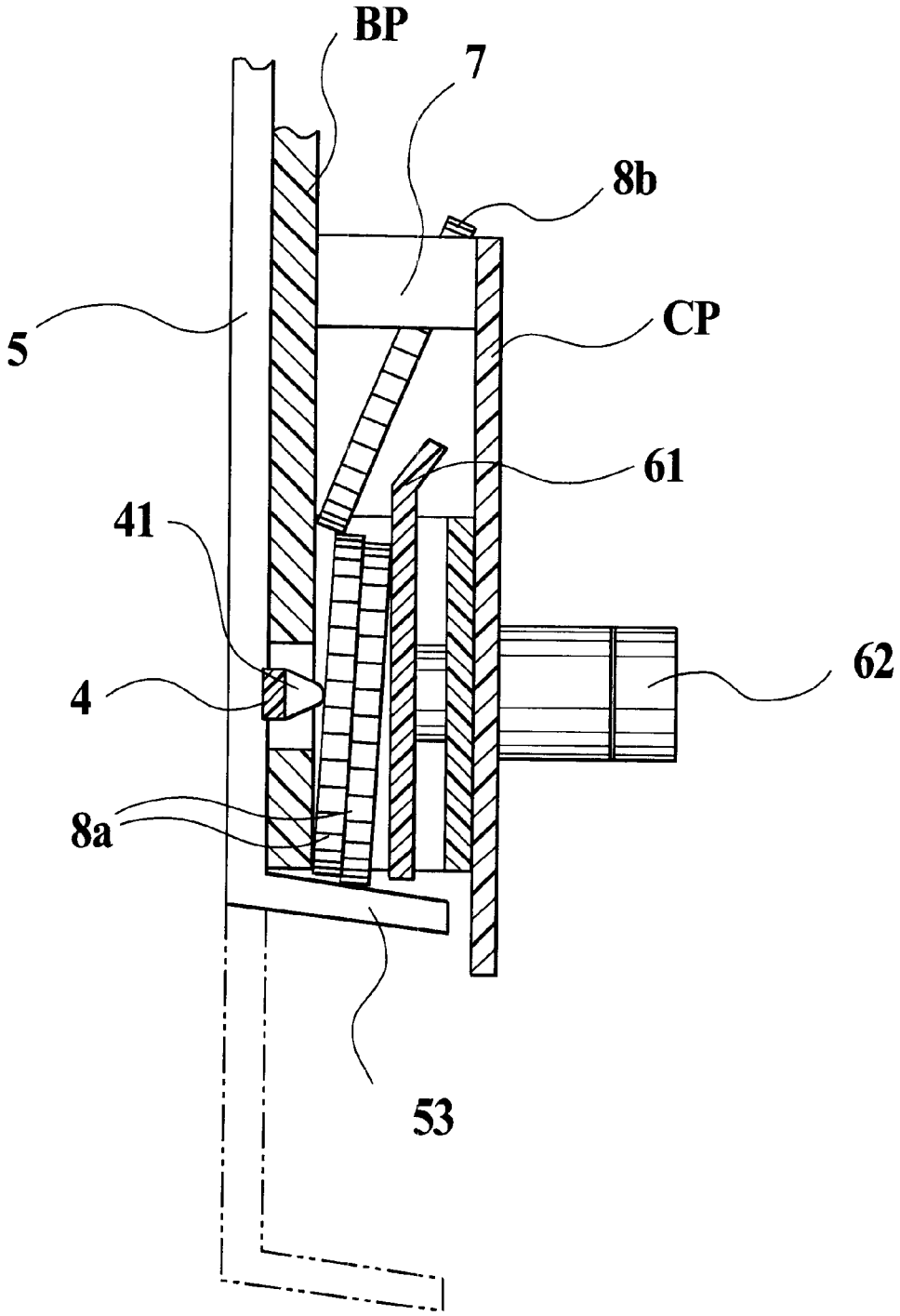
FIG. 4 is a vertical sectional view taken on line IV—IV in FIG. 2.

As shown in FIG. 4, when the predetermined number of coins 8*a* (two coins in this embodiment) are reserved in the temporary reserve portion 6, the top end 41 of the engaging piece 4 abuts against a flat surface part of a coin 8*a* and accordingly, it is prevented from further entering the temporary reserve portion 6. Thus, the top end 41 is not engaged with the engaging portion 32, and accordingly, the stocker 3 can be moved to the transfer position. It is noted that when surplus coins 8*b* are carried on the coins 8*a* at upper position of the coins 8*a* by inserting two coins or more, a scraper 7 formed on the cover plate CP restrains movement of the surplus coins 8*b* and drops the surplus coins from the temporary reserve portion 6. Accordingly, the surplus coins 8*b* are returned to the outside along the arrow D shown in FIG. 2. When the stopper member 5 is depressed down, the stopper portion 53 is moved downward, and accordingly, the temporarily reserved coins 8*a* and the surplus coins 8*b* can be discharged along the arrow D.

An adjusting plate 61 is provided in the temporary reserve portion 6, and accordingly, the space between the adjusting plate 61 and the stationary board BP can be adjusted through the movement of the adjusting plate 6 back and forth by rotating an adjusting knob 62. That is, thereby the desired number of coins can be changed. This adjusting mechanism may be of a cam type or a screw type.

Figure 5:
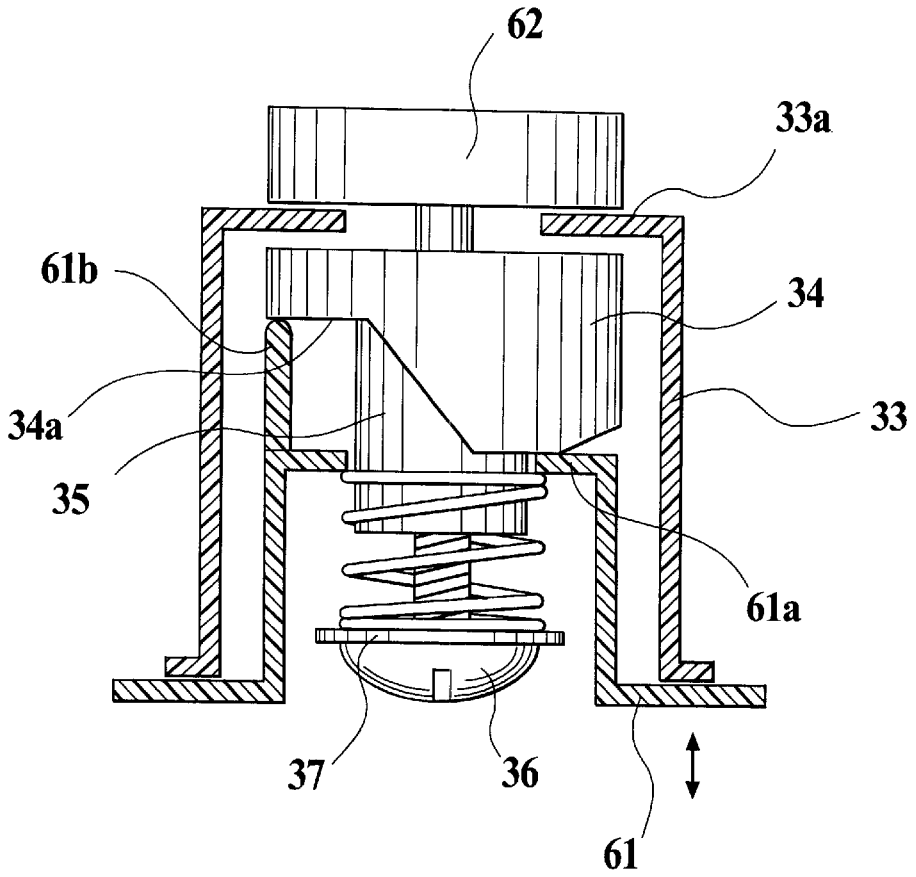
Figure 6:
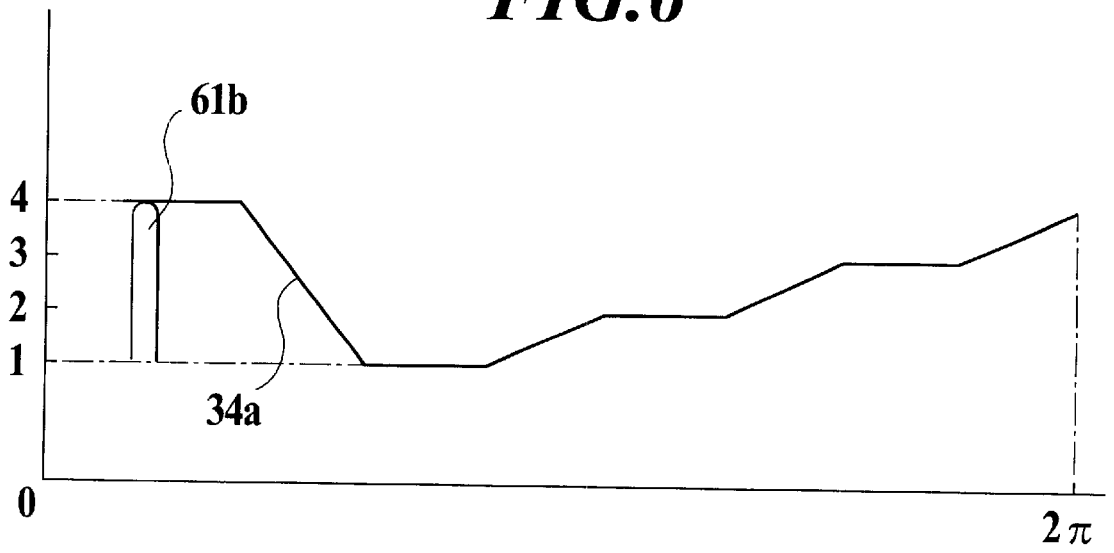
FIG. 6 is a view illustrating a line of a cam in the adjusting mechanism shown in FIG. 5.

FIG. 5 shows one of the cam type adjusting mechanism while. FIG. 6 shows a line of the cam. Explanation will be hereinbelow made of this adjusting mechanism.

The adjusting knob 62 is coupled to a cam portion 34. The cam portion 34 is faced to the adjusting knob 62 through an end portion 33 of a cylindrical part 33. In FIG. 5, the reference humeral 34*a* denotes a cam surface. FIG. 6 shows a development shape of the cam surface 34*a*. Further, to the shaft (cam shaft) 35 of the adjusting knob 62, an adjusting plate 61 is attached so as to be movable axially. That is, a screw 36 is threadedly engaged with the front end side of the shaft 35, and a spring is interposed between a washer 37 for the screw 36 and a recess portion 61*a* in the adjusting plate 61. Further, a projecting pin 61*b* is formed outside of the recess 61 a so that the distal end of the pin is abutting against the cam portion. As a result, by turning the adjusting knob 62, the adjusting plate 61 comes into or out of the cylindrical part 33 so as to change the number of temporary reserved coins. The number of coins can be adjusted within a range from one to four, although the number of coins should not be specifically limited in the present invention.

As mentioned above, because the coin counting device according to the present invention counts the number of coins by using the stocker 3 which is movable horizontally and the engaging piece 4, it is possible to simplify the structure thereof and to reduce the space for installation.

Although only the coin (hard money) counting apparatus was explained in the above embodiment, the present invention should not be limited to this type of coin counting device, it can be applied in a coin counting device for counting game coins. Further, although the coin counting device according to the embodiment of the present invention is used in combination of the coin sorting device in the embodiment, the coin counting device can be solely used, for example, in the case of the game coins or the like.

The entire disclosure of Japanese Patent Application No. Tokugan 2000-19297 filed on Jan. 27, 2000 including specification, claims, drawings and summary are incorporated herein by reference in its entirety.

Because the coin counting device according to the present invention counts the number of coins by using the stocker 3 which is movable horizontally and the engaging piece 4, it is possible to simplify the structure thereof and to reduce the space for installation.

What is claimed is:

1. A coin counting device comprising:

a coin temporary reserve member having a chamber to contain a plurality of coins to temporarily reserve the coins therein in a standing condition, the coin temporary reserve member being able to move reciprocally and laterally between a temporary reserve position and a transfer position; and an engaging member which inhibits the coin temporary reserve member to move from the temporary reserve position to the transfer position when a number of the coins reserved in the temporary reserve member is smaller than a predetermined number, and which permits the temporary reserve member to move from the temporary reserve position to the transfer position when the number of coins reserved therein is equal to the predetermined number.

2. The coin counting device as claimed in claim 1, further comprising:

a base plate on which the coin temporary reserve member is provided;

a stopper member provided on the base plate, for supporting a coin in the coin temporary reserve member from a lower side to prevent the coin from dropping out of the coin temporary reserve member while the coin temporary reserve member is at the temporary reserve position, and for releasing a support for the coin to permit the coin to drop out of the coin temporary reserve member while the coin temporary reserve member is at the transfer position; and the engaging member provided on the base plate, which presses a surface of the coin in the coin temporary reserve member by a predetermined urging force, while the coin temporary reserve member to move from the temporary reserve position to the transfer position.

3. The coin counting device as claimed in claim 1, further comprising a coin number adjusting mechanism for increasing or decreasing the predetermined number of coins to be temporarily reserved.

4. A coin counting device as claimed in claim 1, wherein the chamber is formed of side walls, and the engaging member comprises:

an engaging piece having a top end so that the top end enters into the chamber of the coin temporary reserve member when the predetermined number of coins are not yet reserved in the chamber; and an engaging portion forming one of the side walls of the chamber and is engageable with the top end of the engaging piece to prevent a further movement toward the transfer position.

5. A coin counting device comprising:

a coin temporary reserve member to temporarily reserve coins therein in a standing condition, the coin temporary reserve member being able to move reciprocally and laterally between a temporary reserve position at which one of the coins is put into the temporary reserve portion and a transfer position at which none of the coins are placed therein; and an engaging member which inhibits the coin temporary reserve member to move from the temporary reserve position to the transfer position when a number of the coins reserved in the temporary reserve member is smaller than a predetermined number, and which permits the temporary reserve member to move from the temporary reserve position to the transfer position when the number of the coins reserved therein is equal to the predetermined number, wherein the temporary reserving member comprises a scraper to remove the surplus coins from the temporary reserve member when the temporary reserve member is moved from the temporary reserve position to the transfer position.

6. The coin counting device as claimed in claim 5, wherein the temporary reserving member comprises a scraper for removing the surplus coins from the temporary reserve member when the temporary reserve member is moved from the temporary reserve position to the transfer position.

7. The coin counting device as claimed in claim 5, further comprising a coin number adjusting mechanism for increasing or decreasing the predetermined number of coins to be temporarily reserved.

8. A coin counting device comprising:

a coin temporary reserve member to temporarily reserve coins therein in a standing condition, the coin temporary reserve member being able to move reciprocally and laterally between a temporary reserve position and a transfer position; and an engaging member which inhibits the coin temporary reserve member to move from the temporary reserve position to the transfer position when a number of the coins reserved in the temporary reserve member is smaller than a predetermined number, and which permits the temporary reserve member to move from the temporary reserve position to the transfer position when the number of the coins reserved therein is equal to the predetermined number, wherein the temporary reserving member comprises a scraper to remove the surplus coins from the temporary reserve member when the temporary reserve member is moved from the temporary reserve position to the transfer position.

9. A coin counting device comprising:

a chamber to contain a plurality of coins to temporarily reserve the coins therein in a standing condition, the chamber moving between a first position and a second position; and an engaging member to inhibit the chamber from moving from the first position to the second position when a number of the reserved coins is smaller than a predetermined number, and to allow the chamber to move from the first position to the second position when the number of the reserved coins is equal to the predetermined number.

* * * * *